US008226180B2

(12) United States Patent
Patil et al.

(10) Patent No.: US 8,226,180 B2
(45) Date of Patent: Jul. 24, 2012

(54) DOOR COUPLING SYSTEM

(75) Inventors: Mahendra Madhukar Patil, Karnataka (IN); Timothy Scott Shaffer, LaGrange, KY (US); Derek Lee Watkins, Elizabethtown, KY (US)

(73) Assignee: General Electric Company, Schenectady, NY (US)

( * ) Notice: Subject to any disclaimer, the term of this patent is extended or adjusted under 35 U.S.C. 154(b) by 785 days.

(21) Appl. No.: 12/328,230

(22) Filed: Dec. 4, 2008

(65) Prior Publication Data

US 2010/0139169 A1 Jun. 10, 2010

(51) Int. Cl.

| | |
|---|---|
| ***A47B 95/00*** | (2006.01) |
| ***A47B 88/00*** | (2006.01) |
| ***E05C 7/06*** | (2006.01) |
| ***E05F 17/00*** | (2006.01) |

(52) U.S. Cl. ..... 312/325; 49/104; 49/109; 312/324

(58) Field of Classification Search ..... 312/324–326, 312/329, 138.1, 139, 319.5–319.8; 49/73.1, 49/104, 109, 111, 114; 126/192, 197
See application file for complete search history.

(56) References Cited

U.S. PATENT DOCUMENTS

| | | | | |
|---|---|---|---|---|
| 1,272,853 | A * | 7/1918 | Rodin | 49/109 |
| 1,373,567 | A * | 4/1921 | Overlien | 49/109 |
| 2,025,480 | A * | 12/1935 | Sponsler | 49/103 |
| 2,119,589 | A * | 6/1938 | Lutz | 16/84 |
| 2,598,814 | A * | 6/1952 | McAfee | 312/275 |
| 2,708,709 | A | 5/1955 | Pearce | |
| 2,750,929 | A * | 6/1956 | Bronson | 415/51 |
| 2,997,041 | A * | 8/1961 | Wolske | 126/191 |
| 3,750,643 | A * | 8/1973 | Fowler et al. | 126/197 |
| 4,653,227 | A * | 3/1987 | Condon et al. | 49/110 |
| 5,469,657 | A * | 11/1995 | Drew | 49/68 |
| 5,636,715 | A * | 6/1997 | Hayashi et al. | 187/330 |
| 5,690,188 | A * | 11/1997 | Takakusaki et al. | 187/319 |
| 5,722,202 | A * | 3/1998 | Cooper | 49/109 |
| 5,931,034 | A * | 8/1999 | Fisher | 70/264 |
| 2007/0039605 | A1 * | 2/2007 | Larsen | 126/191 |
| 2007/0039606 | A1 * | 2/2007 | Larsen et al. | 126/197 |
| 2009/0145031 | A1 * | 6/2009 | Collene | 49/113 |

OTHER PUBLICATIONS

BCX Series Combi Stacked on a Full-Size Gas Convection Oven, Blodegett Oven Company, 44 Lakeside Avenue, Burlington, Vermont 05401.

Electric, Full-Size, Stacked/ChefSeries™ Convection Ovens, Lang Manufacturing, 10 Sunnen Drive, St. Loius, Missouri 63143.

* cited by examiner

*Primary Examiner* — Darnell Jayne
*Assistant Examiner* — Andrew Roersma
(74) *Attorney, Agent, or Firm* — Global Patent Operation; Douglas D. Zhang

(57) ABSTRACT

An apparatus including a frame forming an internal cavity, the frame having an opening for accessing the internal cavity, a first door and a second door mounted to the frame and a door coupling mechanism for effecting a substantially simultaneous movement of the first door and second door relative to the frame, the door coupling mechanism including a first door link, a second door link and at least one ternary link, the first door link being rotatably coupled to the first door and the at least one ternary link, the second door being rotatably coupled to the second door and the at least one ternary link.

10 Claims, 11 Drawing Sheets

DOOR COUPLING SYSTEM

BACKGROUND OF THE INVENTION

The exemplary embodiments of the present invention generally relate to door coupling systems. More particularly, the exemplary embodiments relate to coupling systems for French style doors and apparatus incorporating such coupling systems.

Generally French style door design provides several benefits over conventional appliance doors such doors for cooking ranges and refrigerators. One benefit of French doors is enhanced ergonomics of accessing contents to be placed in or removed from an internal cavity of the appliance. French doors also minimize the space needed to swing the doors open and closed due to the reduced width of the door when compared to a single door appliance having a similar face width.

Generally French door systems without interconnected doors are operated with two hands where both doors are generally opened simultaneously. Some French door systems also require that the doors be opened in a specific order (e.g., the left side door is to be opened before the right side door) so that, for example, adequate sealing is achieved when the doors are closed.

French door systems with interconnected doors generally include components such as, for example, gear or chain transmissions for interconnecting the doors so that as a user opens one door, the other door is also opened. Generally these gear or chain transmissions introduce backlash in the operation of the doors so that the door operation is often unsatisfactory in terms of feel and door closing. In addition, the interconnected door transmissions generally include a significant number of parts and are space inefficient.

BRIEF DESCRIPTION OF THE INVENTION

As described herein, the exemplary embodiments overcome one or more of the above or other disadvantages known in the art.

One aspect of the exemplary embodiments relates to an apparatus. The apparatus includes a frame forming an internal cavity, the frame having an opening for accessing the internal cavity, a first door and a second door hingably mounted to the frame on opposite sides of the opening for selectively sealing the opening, and a door coupling mechanism for effecting a substantially simultaneous movement of the first door and second door relative to the frame, the door coupling mechanism including a first door link having a first end and a second end, the first end of the first door link being rotatably coupled to the first door, a second door link having a first end and a second end, the first end of the second door link being rotatably coupled to the second door, and at least one ternary link movably mounted to the frame, the ternary link coupling the first door link to the second door link wherein the second ends of the first door link and second door link are rotatably coupled to the at least one ternary link.

Another aspect of the exemplary embodiments relates to a door coupling mechanism for effecting simultaneous operation of a first and second door mounted to an appliance. The door coupling mechanism includes at least one ternary link rotatably mounted to a frame of the appliance, a first door link being rotatably coupled at one end to the first door and rotatably coupled at a second opposite end to a first rotatable coupling on the at least one ternary link, and a second door link being rotatably coupled at one end to the second door and rotatably coupled at a second opposite end to a second rotatable coupling on the at least one ternary link, the first and second rotatable couplings being spatially separated from each other.

Still another aspect of the exemplary embodiments relates to a door coupling mechanism for effecting simultaneous operation of a first and second door mounted to an appliance. The door coupling mechanism includes a ternary link reciprocatingly or slidably mounted to a frame of the appliance for traveling along a first substantially linear path, a first door link being rotatably coupled at one end to the first door and rotatably coupled at a second opposite end to a first rotatable coupling on the ternary link, and a second door link being rotatably coupled at one end to the second door and rotatably coupled at a second opposite end to a second rotatable coupling on the ternary link, each of the first and second rotatable couplings being reciprocatingly or slidably mounted to the frame for respectively traveling along a second and third substantially linear path.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1A:
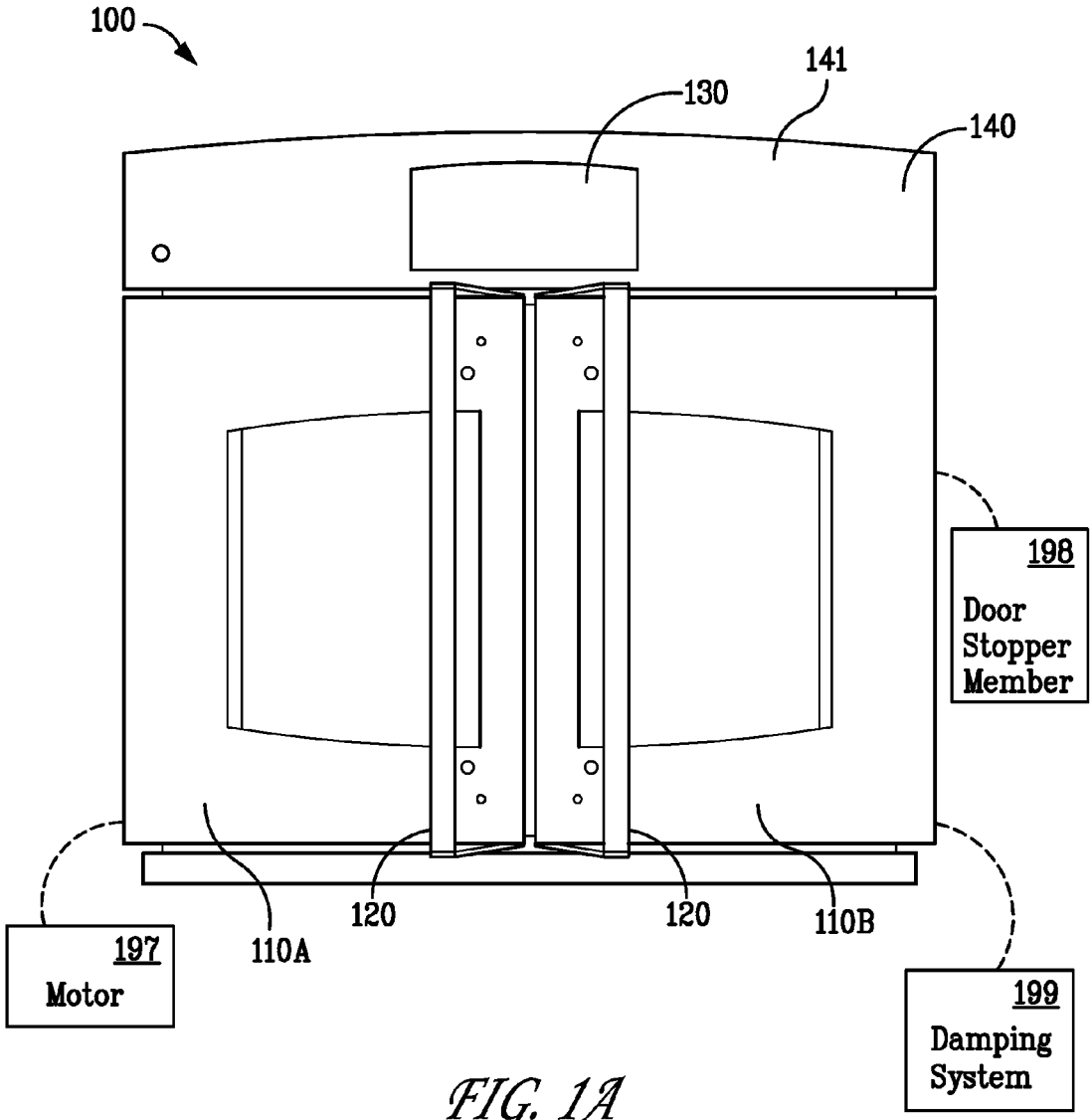
FIGS. 1A and 1B illustrate an exemplary appliance in accordance with an exemplary embodiment.
Figure 1B:
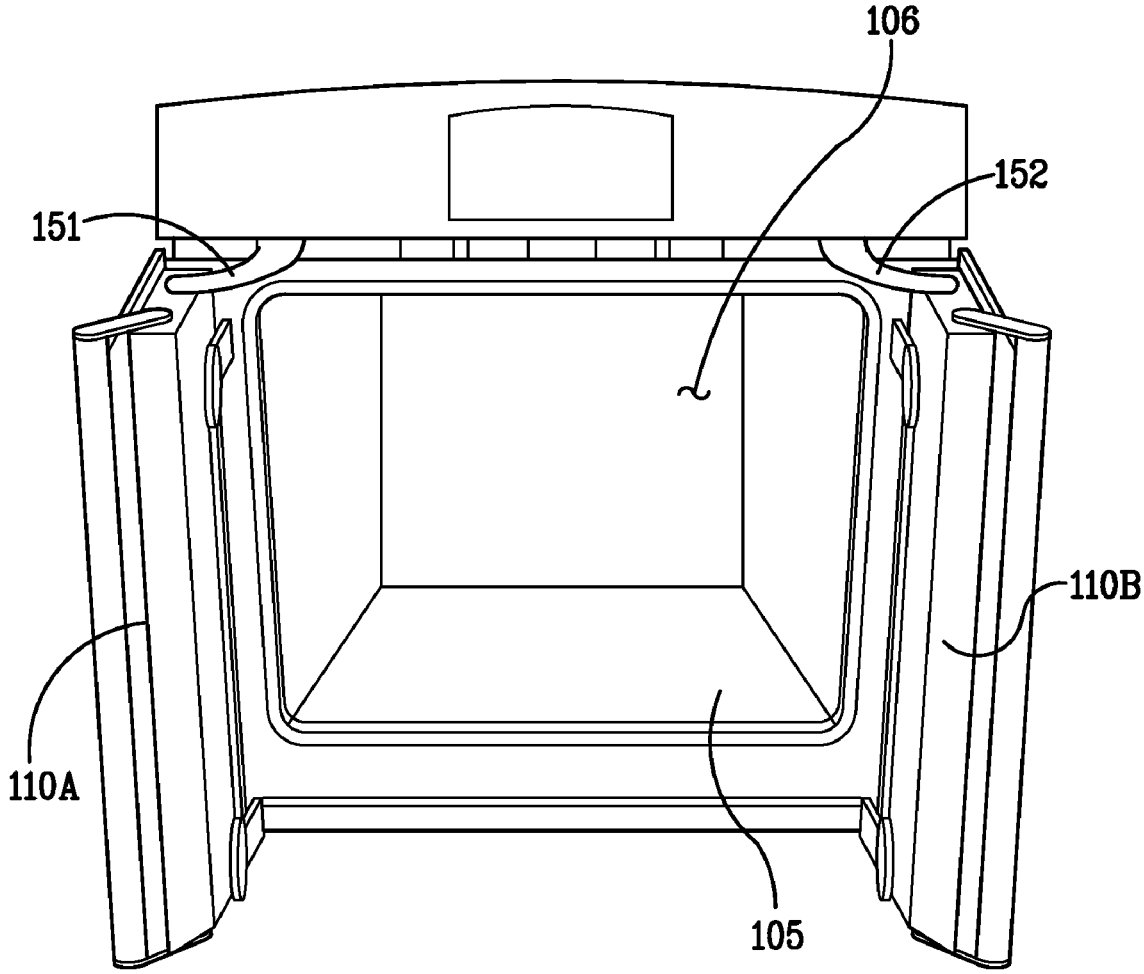

FIGS. 1A and 1B illustrate an exemplary appliance 100 incorporating a door coupling system in accordance with an exemplary embodiment of the invention. By way of a non-limiting example, the appliance 100 is shown as a freestanding cooking oven. The invention can be used in other types of appliances, such as refrigerators, ovens, clothes washers, dryers, and dishwashers. As can be seen in FIGS. 1A and 1B, the appliance 100 includes French doors (e.g. first and second doors 110A, 110B).

The disclosed exemplary embodiments provide for a door coupling mechanism that allows for the simultaneous operation of both the first and second doors 110A, 110B when an opening or closing force is applied to either one of the doors. The exemplary configurations of the door coupling mechanism couples the first and second doors 110A, 110B through at least one ternary link that is pivotally mounted on a structural member or frame of the appliance 100. The exemplary embodiments also provide for an enhanced feel of door operation.

Still referring to FIGS. 1A and 1B, the appliance 100 further includes a frame 140, a frontal covering 141 and a control panel 130 on the frontal covering 141. The covering 141 and other coverings may be mounted to the frame 140 to give the appliance 100 any suitable aesthetic appearance. The control panel 130 may be any suitable control panel having any suitable control features for operating the appliance 100. The frame 140 defines an internal cavity 106 having a frontal opening 105. The first and second doors 110A, 110B are pivotally mounted to the frame 140 to selectably allow access to the internal cavity 106. For example, the first and second doors 110A, 110B may be suitably sized and shaped to seal the opening 105 when the doors are in a closed configuration and to allow access to the internal cavity 106 through the opening 105 when the doors are in an open configuration. The first and second doors 110A, 110B may be pivotally mounted to the frame 140 at opposite sides of the frame 140 by, for example, suitable door hinges 151, 152 so that each door swings outward towards its respective side of the frame as can be best seen in FIG. 1B. As can be seen in FIGS. 1A and 1B, the first and second doors 110A, 110B are substantially vertically hinged. In alternate embodiments the doors 110A, 110B may be horizontally hinged or hinged at any other suitable angle relative to a horizontal or vertical plane. Each of the first and second doors 110A, 110B may include a suitable handle 120 or other grasping device configured to allow, for example, the application of at least the opening force for causing the opening operation of the first and second doors 110A, 110B.

Figure 2:
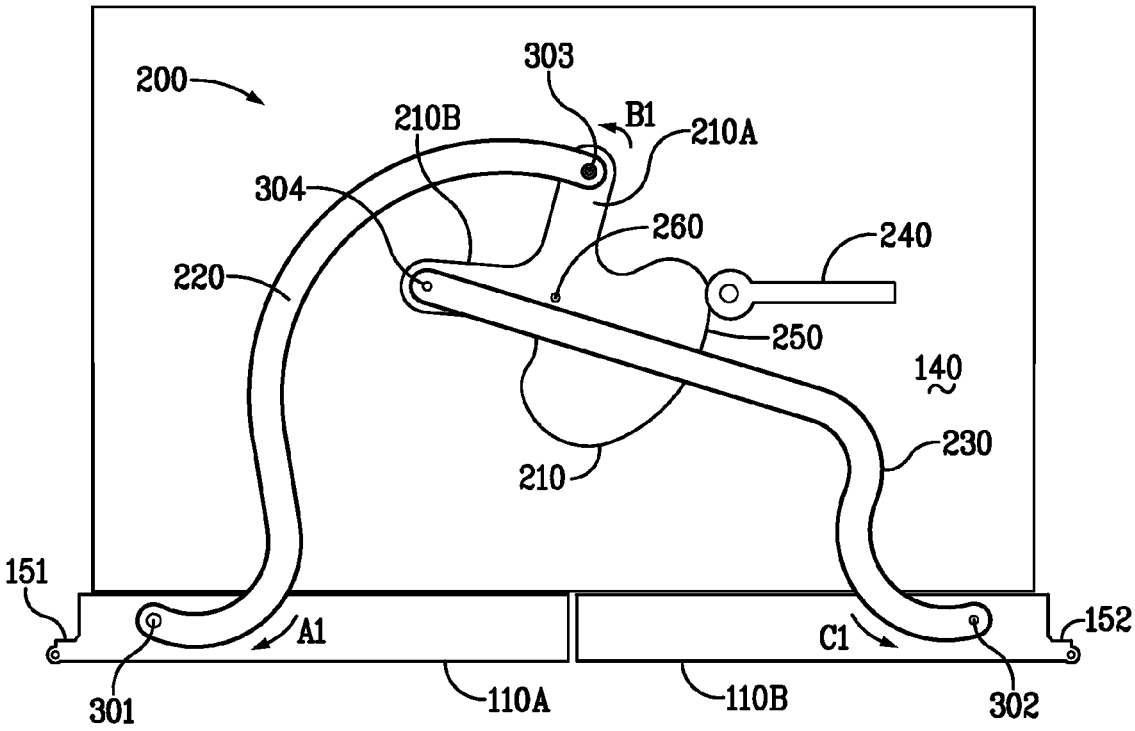
FIG. 2 is a schematic, cross section view of the appliance of FIGS. 1A and 1B at a plane above the doors thereof, showing a door coupling system in accordance with an exemplary embodiment.

FIG. 2 shows a door coupling mechanism 200 in accordance with an exemplary embodiment. It should be understood that the shape and configuration of the components shown in FIG. 2 are for exemplary purposes only and in alternate embodiments the components may have any suitable shape and configurations for causing the simultaneous opening and closing of the first and second doors 110A, 110B. The door coupling mechanism 200 includes a first door link 220, a second door link 230 and a ternary link 210. For exemplary purposes, the ternary link 210 includes a first arm 210A, a second arm 210B and a cam surface 250. The ternary link 210 may be mounted to the frame 140 by, for example, a first rotatable coupling 260. The first rotatable coupling 260, as well as the other rotatable couplings described herein may be any suitable coupling, such as for example a pin joint, that is configured to allow rotation of the coupled components relative to one another. The first door link 220 includes a first end pivotally coupled to the first door 110A at a second rotatable coupling 301. As can be seen in FIG. 2, the second rotatable coupling 301 is spaced apart from the respective door hinge 151 so that a suitable moment or torque may be applied to the first door 110A by the first door link 220 (or vice versa) during operation of the door coupling mechanism. A second end of the first door link 220 may be pivotally coupled at a third rotatable coupling 303 to the first arm 210A of the ternary link 210. A first end of the second door link 230 may be rotatably coupled to the second door 110B at a fourth rotatable coupling 302. In a manner similar to that described above, the fourth rotatable coupling 302 is spaced apart from the respective door hinge 152 so that a suitable moment or torque may be applied to the second door 110B by the second door link 230 (or vice versa) during operation of the door coupling mechanism. A second end of the second link 230 may be coupled to the second arm 210B of the ternary link 210 at a fifth rotatable coupling 304. It is noted that while the first and second door links 220, 230 are rotatably coupled to the ternary link 210 at separate and spaced apart rotatable couplings 303, 304, in alternate embodiments the first and second door links 220, 230 may be coupled to the ternary link 210 at about one location. In this manner the first door 110A is interconnected to the second door 110B and vice versa so that as an opening or closing force is applied to one of the first and second doors 110A, 110B the other one of the first and second doors 110A, 110B is simultaneously opened or closed.

A cam follower 240 may be suitably mounted to the frame 140 for exerting a force on the cam surface 250 of the ternary link 210. In one exemplary embodiment the cam follower 240 may be a spring-loaded follower configured to ride on or follow the cam surface 250. In alternate embodiments the cam follower 240 may have any suitable configuration for exerting a force on the ternary link 210. The cam follower 240 may be configured to cause the first and second doors 110A, 110B to come to rest at one or more predetermined positions along the doors' motion of travel. The cam follower 240 may also be configured to facilitate storing of potential energy during at least part of the door travel in a first direction between open and closed positions and the subsequent release of the stored potential energy at a predetermined angular position of the door during a reversal of the door travel. The cam follower 240 may be connected to any suitable sensor for sensing a position of the cam follower, which in turn allows for sensing a position of the doors (e.g. open or closed). In alternate embodiments the sensor may sense a position of the doors in any suitable manner. The sensor may relay a signal to, for example, a controller of the appliance 100 so that the appliance 100 may be operated only upon a predetermined door position.

In accordance with another exemplary embodiment, the door coupling mechanism 200 may include a door latching mechanism (not shown) for engaging any one of the ternary link 210, the first door link 220 or the second door link 230 for constraining the door coupling mechanism 200 so that both the first and second doors 110A, 110B are substantially locked in any suitable predetermined position such as, for example, a closed position. In one example the door latching mechanism may be electrically actuated constraining the door coupling mechanism 200. In alternate embodiments, the door latching mechanism may be actuated in any suitable manner, such as, for example, manually actuated.

In an exemplary operation of the door coupling mechanism 200, as an opening force is applied to, for exemplary purposes only, the first door 110A in the direction of arrow A1, the first door 110A pivots about the door hinge 151. Rotation of the first door 110A about the door hinge 151 causes movement of the first door link 220 such that the first door link 220 causes the ternary link 210 to rotate about the first rotatable coupling 260 in a first direction that is substantially in the direction of arrow B1. Rotation of the ternary link 210 in the direction of arrow B1 causes movement of the second door link 230 such that a moment C1 is created between the fourth rotatable coupling 302 and the door hinge 152, causing the second door 110B to open simultaneously with the first door 110A.

It should be understood that the opening force may alternatively be applied to the second door 110B such that the second door link 230 causes the ternary link 210 to rotate about the first rotatable coupling 230 in the direction of arrow B1. Rotation of the ternary link 210 causes movement of the first door link 220 for creation of a moment (similar to moment C1) between the second rotatable coupling 301 and the door hinge 151 for causing simultaneous opening of the first door 110A. Closing of the first and second door occurs in a substantially opposite manner to that described above.

Figure 3:
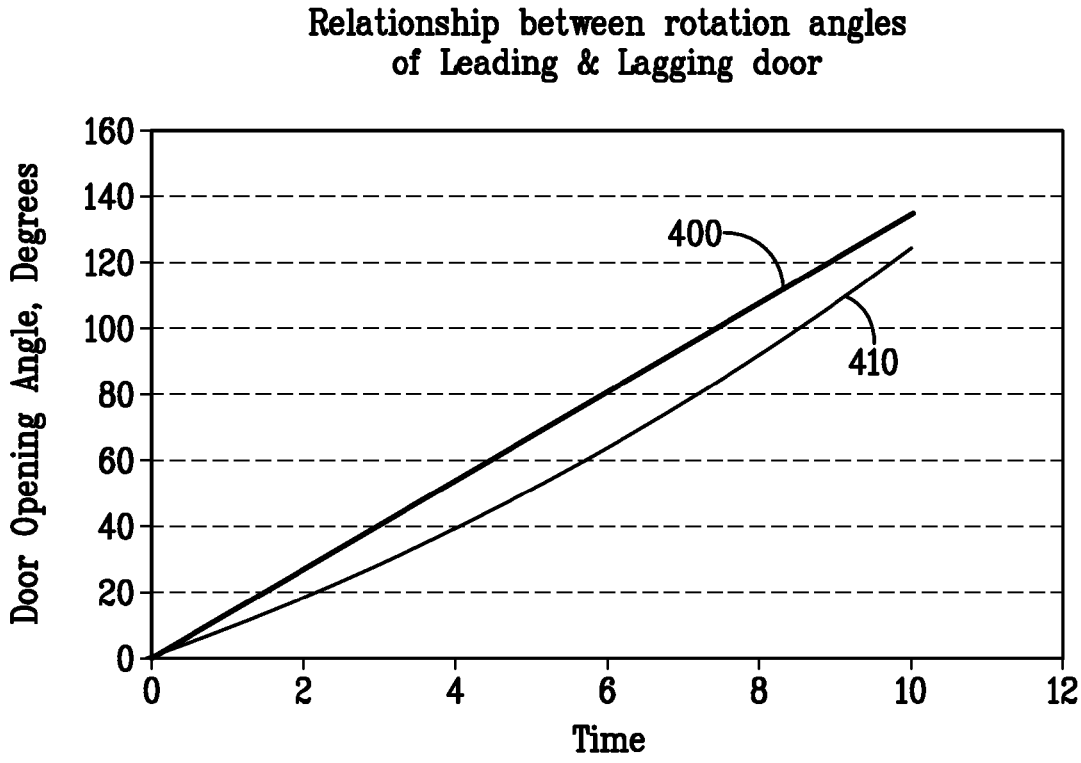
FIG. 3 is a graph illustrating relative door lag degrees of the doors door rotation angles for the door coupling system of FIG. 2.
Figure 4:
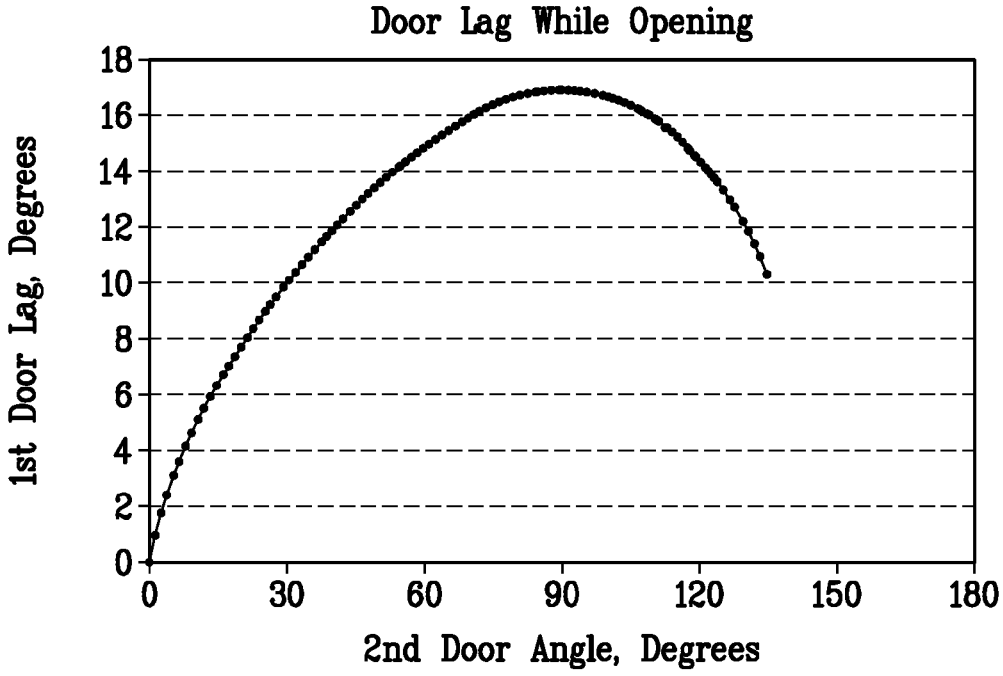
FIG. 4 is a graph illustrating door lag for the door coupling system of FIG. 2.

It is noted that the configuration of the first and second arms 210A, 210B of the ternary link 210, the first and second door links 220, 230 and/or the rotatable couplings may be such that one of the first and second doors 110A, 110B lags behind the other one of the first and second doors 110A, 110B as the doors are opened or closed. FIG. 3 illustrates the relationship between the rotation angles of the first and second doors 110A, 110B for the door coupling mechanism of FIG. 2, as each door pivots about its respective door hinge 151, 152, where line 400 indicates the rotation angle of the leading door and line 410 indicates the rotation angle of the lagging door. FIG. 4 illustrates the door lag between the leading door and the lagging door during an opening of the doors. The door lag is almost zero when the doors are just being opened. In alternate embodiments the shapes of the linking members may be selected to achieve the desired amount of lag or to provide for the doors to open and close without any substantial lag relative to each other.

Figure 5:
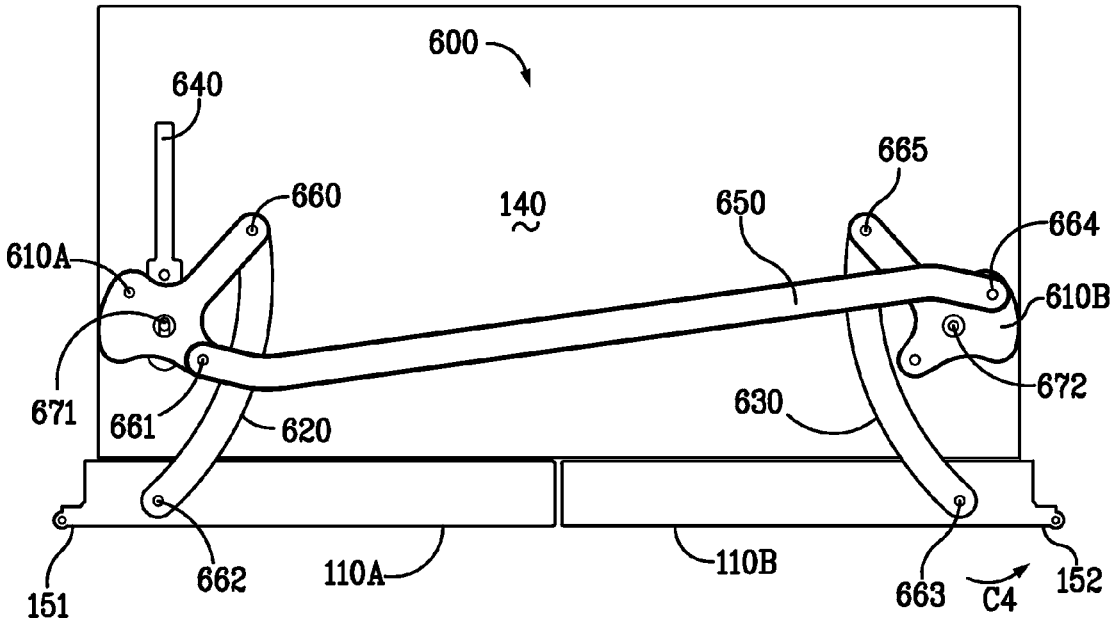
FIGS. 5 and 6 are schematic illustrations of a door coupling system and its operation in accordance with another exemplary embodiment.
Figure 6:
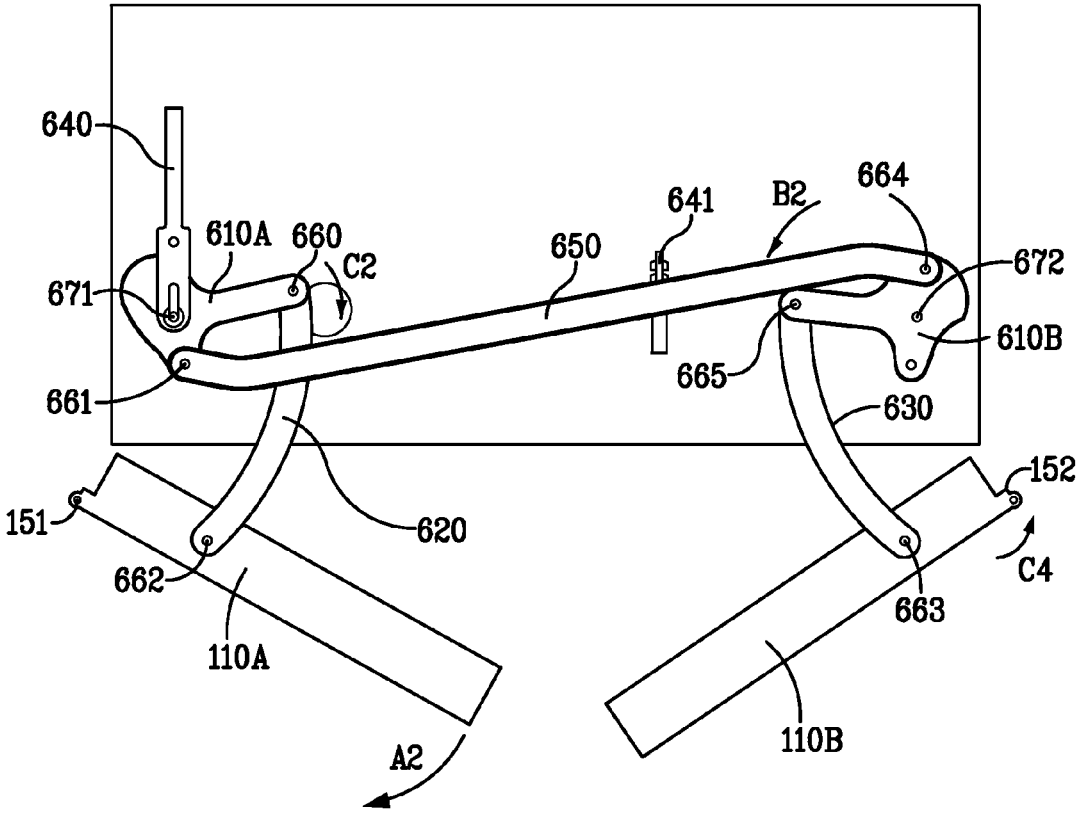

FIGS. 5 and 6 illustrate another exemplary door coupling mechanism 600. In this example, the door coupling mechanism 600 includes a first door link 620, a second door link 630, a first ternary link 610A, a second ternary link 610B and a connecting link 650. It should be understood that the shape and configuration of the components shown in FIGS. 5 and 6 are for exemplary purposes only and in alternate embodiments the components may have any suitable shape and configurations for causing the simultaneous opening and closing of the first and second doors 110A, 110B. It is noted that the first and second ternary links 610A, 610B may be substantially similar to the ternary link 210 described above. The first and second ternary links 610A, 610B may be rotatably mounted to the frame 140 respectively at first and second rotatable couplings 671, 672. A first end of the first door link 620 may be rotatably mounted to the first door 110A at a third rotatable coupling 662 and a second end of the first door link 620 may be rotatably mounted to the a first arm of the first ternary link 610A at a fourth rotatable coupling 660. A first end of the connecting link 650 may be mounted to a second arm of the first ternary link 610A at a fifth rotatable coupling 661 and a second end of the connecting link 650 may be rotatably mounted to the second ternary link 610B at a sixth rotatable coupling 664. In this example, the rotatable coupling 664 is located on a lobed portion of the second ternary link 610B from which the first and second arms extend but in alternate embodiments the connecting link 650 may be coupled to any suitable portion of the second ternary link 610B. A first end of the second door link 630 may be rotatably coupled to a first arm of the second ternary link 610B at a seventh rotatable coupling 665 and a second end of the second door link 630 may be rotatably coupled to the second door 110B at an eighth rotatable coupling 663. In this manner the first door 110A is interconnected with the second door 110B and vice versa so that as a opening or closing force is applied to one of the first and second doors 110A, 110B, the other one of the first and second doors 110A, 110B is simultaneously opened or closed.

One or more cam followers 640, that may be substantially similar to cam follower 240 described above, may be suitably mounted to, for example, the frame 140 for engaging one or more of the first and second ternary links 610A, 610B for causing the first and second doors 110A, 110B to come to rest at one or more predetermined positions along the doors' motion of travel (e.g. the opened or closed positions or any other position therebetween) and/or facilitating the storing and releasing of potential energy as describe above. A door latching mechanism 641 (FIG. 6) may also be included for engaging one or more links of the door coupling mechanism 600 for securing or locking the first and second doors 110A, 110B in a manner similar to that described above.

Referring to FIG. 6, an exemplary operation of the door coupling mechanism 600 will be described. As an opening force is applied to, for exemplary purposes only, the first door 110A in the direction of arrow A2, the first door 110A pivots about the door hinge 151. Rotation of the first door 110A about the door hinge 151 causes movement of the first door link 620 such that the first door link 620 causes the first ternary link 610A to rotate about the first rotatable coupling 671 in a first direction that is substantially in the direction of arrow C2. Rotation of the first ternary link 610A causes movement of the connecting link 650 such that the second ternary link 610B is caused to rotate about the second rotatably coupling 672 in a second direction that is substantially in the direction of arrow B2. It is noted that, in this example, the second direction is substantially opposite the first direction but in alternate embodiments the links may be configured such that second direction may be substantially the same as the first direction. Rotation of the second ternary link 610B causes movement of the second door link 630 for creating a moment C4 between the eighth rotatable coupling 663 and door hinge 152 for causing the simultaneous opening of the second door 110B.

It should be understood that the opening force may alternatively be applied to the second door 110B such that the second door link 630 causes the second ternary link 610B to rotate in the direction of arrow B2. Rotation of the ternary link 610B in the direction of arrow B2 causes movement of the connecting link 650 for rotating the first ternary link 610A in the direction of arrow C2. Rotation of the first ternary link 610A creates a moment (similar to moment C4) between the third rotatable coupling 662 and the door hinge 151 for causing simultaneous opening of the first door 110A. Closing of the first and second door occurs in a substantially opposite manner to that described above.

Figure 7:
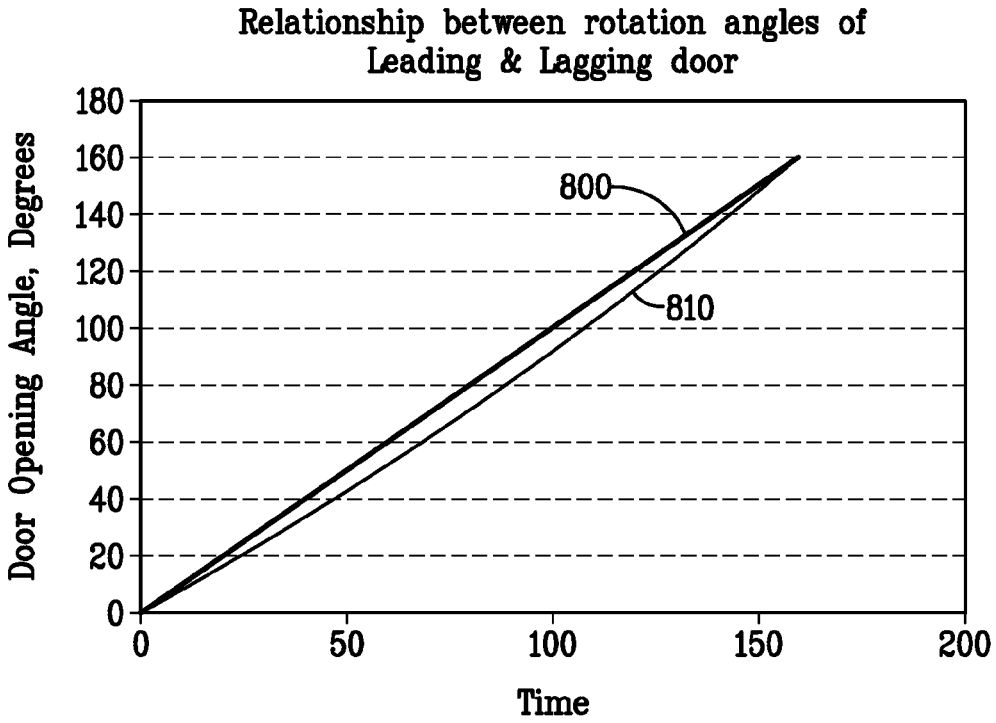
FIG. 7 is a graph illustrating door rotation angles for the door coupling system of FIG. 5.
Figure 8:
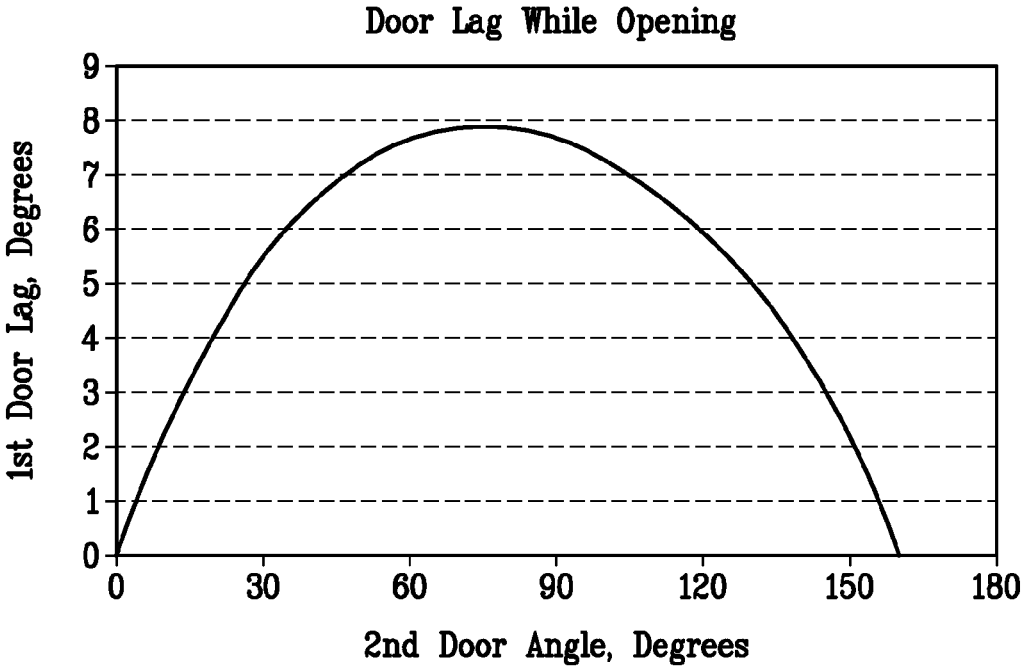
FIG. 8 is a graph illustrating door lag for the door coupling system of FIG. 5.

It is noted that the configuration of the first and second arms of the first and/or second ternary links 610A, 610B, the first and second door links 620, 630, the connecting link 650 and/or the rotatable couplings may be such that one of the first and second doors 110A, 110B lags behind the other one of the first and second doors 110A, 110B as the doors are opened or closed. FIG. 7 illustrates the relationship between the rotation angles of the first and second doors 110A, 110B for the door coupling mechanism of FIGS. 5 and 6, as each door pivots about its respective door hinge 151, 152, where line 800 indicates the rotation angle of the leading door and line 810 indicates the rotation angle of the lagging door. FIG. 8 illustrates the door lag between the first and second doors 110A, 110B during an opening of the doors 110A, 110B. As illustrated in FIGS. 7 and 8, the door lag is almost zero degree when the doors 110A, 110B are just being opened or about to be in the fully closed position. The maximum door lag during the door rotation from 0 to 15 degrees is less than 10 degrees, and the maximum door lag during the entire door rotation is less than 20 degrees. As noted above, more or less lag or substantially no lag may be achieved by adjusting the shapes of the linking members.

Figure 9A:
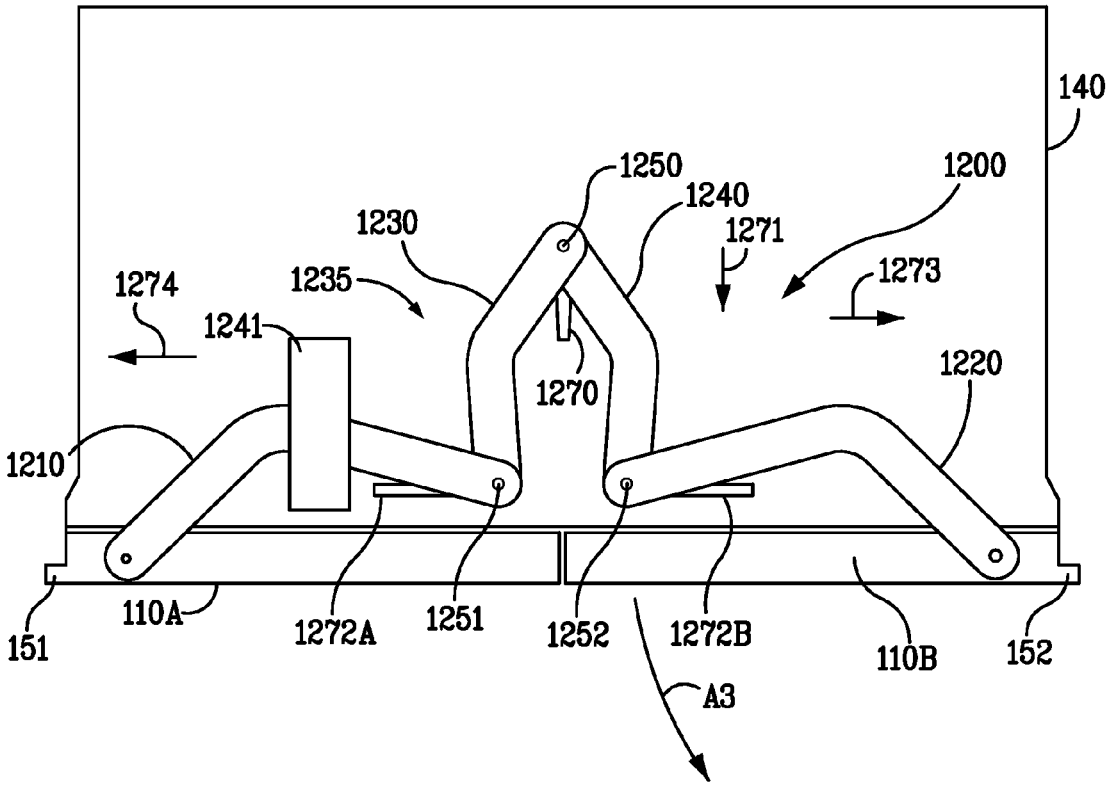
FIGS. 9A and 9B are schematic illustrations of a door coupling mechanism and its operation in accordance with another exemplary embodiment.
Figure 9B:
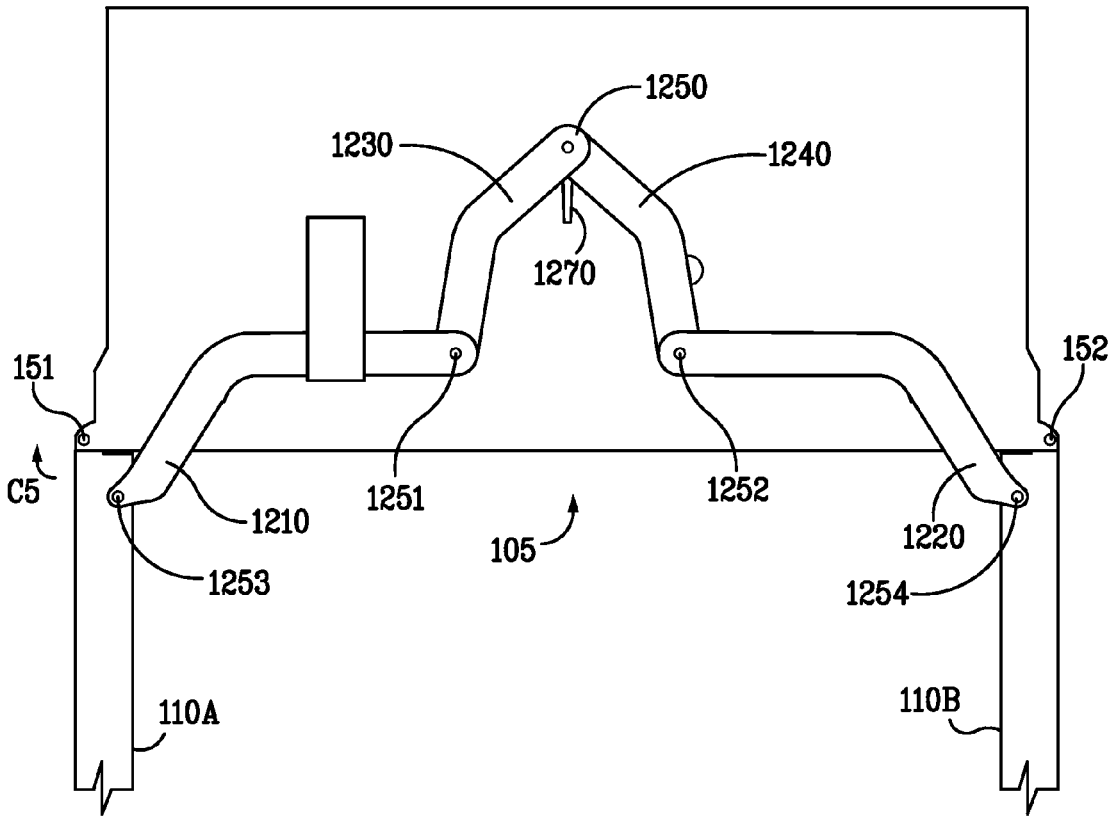

FIGS. 9A and 9B show another exemplary door coupling mechanism 1200. In this example, the door coupling mechanism 1200 includes a first door link 1210, a second door link 1220 and a ternary link 1235. It should be understood that the shape and configuration of the components shown in FIGS. 9A and 9B are for exemplary purposes only and in alternate embodiments the components may have any suitable shape and configurations for causing the simultaneous opening and closing of the first and second doors 110A, 110B. A first end of the first door link 1210 is rotatably coupled to the first door 110A at a first rotatable coupling 1253. A second end of the first door link 1210 is rotatably coupled to the ternary link 1235 at a second rotatable coupling 1251. In this example, the ternary link 1235 includes a first and second member 1230, 1240 such that the first door link 1210 is coupled to a first end of the first member 1230 at the second rotatable coupling 1251. A second end of the first member 1230 is rotatably joined to a first end of the second member 1240 at a third rotatable coupling 1250. A second end of the second member 1240 is rotatably coupled to a first end of the second door link 1220 at a fourth rotatable coupling 1252. A second end of the second door link 1220 is rotatably coupled to the second door 110B at a fifth rotatable coupling 1254. In this exemplary embodiment, the rotatable couplings 1250, 1251, 1252 are reciprocally guided along a substantially linear path of motion during opening and closing of the doors 110A, 110B. The third rotatable coupling 1250 is slidably mounted for reciprocal movement, guided in the direction of arrow 1271 along a substantially linear path defined by, a linear slide 1270. The third rotatable coupling 1250 includes a rod which is movably guided in the channel defined in the linear slide 1270). The second and fourth rotatable couplings 1251, 1252 are reciprocally guided in the direction of arrows 1274, 1273 respectively along respective substantially linear paths defined respectively by linear slides 1272A, 1272B or any other suitable guiding mechanisms. In this example, the linear slides may be mounted in any suitable manner to the frame 140. Here the linear slide 1270 is substantially orthogonal to the linear slides 1272A, 1272B but in alternate embodiments the linear slides may be oriented with respect to each other in any suitable manner.

In accordance with an exemplary embodiment, the door coupling mechanism 1200 may include one or more toggling levers, springs, detents and/or any other suitable device (collectively referred to herein as toggle devices) configured to cause the first and second doors 110A, 110B to come to rest at one or more predetermined positions along the doors' motion of travel. These toggle devices may interface with one or more of the rotatable couplings (or any other suitable features of the door links or ternary link) of the door coupling mechanism 1200 for causing one or more resting positions for the doors such as, for example, at the open or closed positions of the doors.

In accordance with another exemplary embodiment, the door coupling mechanism 1200 may include a door latching mechanism 1241 for engaging any one or more of, for example, the first and second door links and/or ternary link (or any other suitable feature of the door coupling mechanism) for constraining the door coupling mechanism 1200 so that both the first and second doors 110A, 110B are substantially locked in any suitable predetermined position such as, for example, a closed position. The door latching mechanism may be substantially similar to the door latching mechanisms described above.

Still referring to FIGS. 9A and 9B, an exemplary operation of the door coupling mechanism 1200 will be described. In operation, as a door opening force is applied in the direction of arrow A3 to, for example, the second door 110B, the first end of second door link 1220 is caused to move in a first direction that is substantially in the direction of arrow 1273 as the fourth rotatable coupling 1252 moves in slide 1272B. Second door link 1220 pivots about the fourth rotatable coupling 1252 during its movement in the direction of arrow 1273 as the second door rotates about door hinge 152. As the fourth rotatably coupling 1252 moves in the direction of arrow 1273, it causes movement of the second end of the second member 1240 in the direction of arrow 1273 which in turn causes the first end of the second member to pivot about and cause the third rotatable coupling 1250 to move substantially linearly in a second direction that is substantially in the direction of arrow 1271. As the third rotatable coupling 1250 moves in the direction of arrow 1271, the second end of the first member 1230 pivots about the third rotatable coupling 1250 and causes the first end of the first member 1230 to move substantially linearly in a third direction that is substantially in the direction of arrow 1274. Movement of the first end of the first member 1230 in the direction of arrow 1274 causes movement of the first door link 1210 via the second rotatable coupling 1251 substantially in the direction of arrow 1274 to create a moment C5 between the first rotatable coupling 1253 and the door hinge 151 for causing the simultaneous opening of the first door 10A. First door link 1210 pivots about the second rotatable coupling 1251 during its movement in the direction of arrow 1274 the first door rotates about door hinge 151.

It should be understood that the opening force may alternatively be applied to the first door 110A such that the first door link 1210 moves in the direction of arrow 1274 and causes movement of the second end of the first member 1230 and first end of the second member 1240 in the direction of arrow 1271. Movement of the first end of the second member 1240 in the direction of arrow 1271 causes the fourth rotatable coupling 1252 and the second door link 1220 to move in the direction of arrow 1273 for creating a moment (similar to moment C5) between the fifth rotatable coupling 1254 and the door hinge 152 for causing the simultaneous opening of the second door 110B. Closing of the first and second door occurs in a substantially opposite manner to that described above.

The embodiment of FIGS. 9A and 9B with links of essentially symmetrical configuration for each door, results in the doors opening and closing with no substantial lag relative to each other. However, it is noted that the configuration of the first and second door links 1210, 1220, the first and second members 1230, 1240, the rotatable couplings and/or the linear slides may be adjusted such that one of the first and second doors 110A, 110B lags behind the other one of the first and second doors 110A, 110B as the doors are opened or closed in a manner substantially similar to that described above.

Figure 10A:
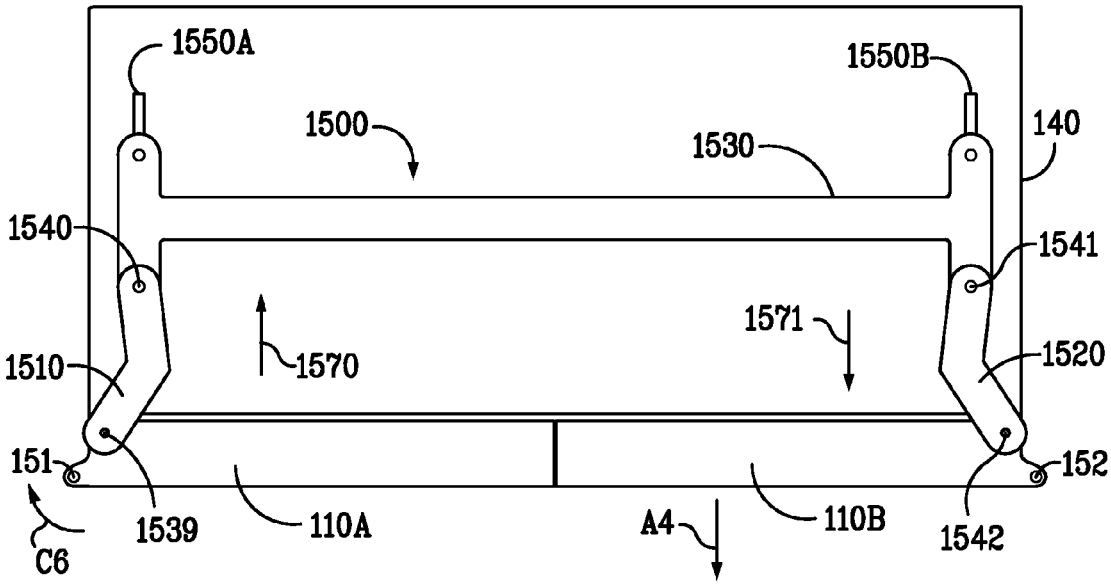
FIGS. 10A and 10B are schematic illustrations of a door coupling mechanism and its operation in accordance with another exemplary embodiment.
Figure 10B:
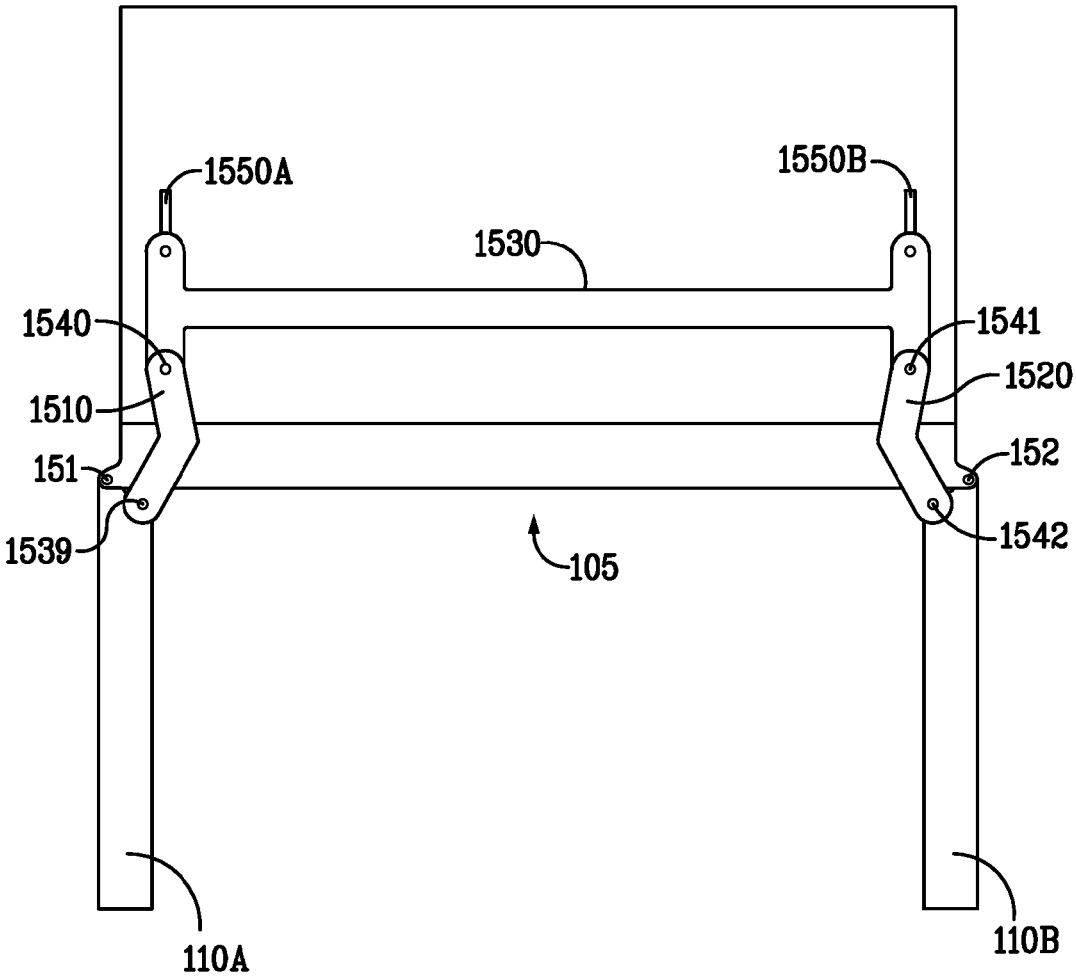

Referring to FIGS. 10A and 10B show another exemplary door coupling mechanism 1500. The door coupling mechanism 1500 includes a first door link 1510, a second door link 1520 and a ternary link 1530. It should be understood that the shape and configuration of the components shown in FIGS. 10A and 10B are for exemplary purposes only and in alternate embodiments the components may have any suitable shape and configurations for causing the simultaneous opening and closing of the first and second doors 110A, 110B. A first end of the first door link 1510 is rotatably coupled to the first door 110A at a first rotatable coupling 1539 (FIG. 10B) and a second end of the first door link 1510 is rotatably coupled to a first end of the ternary link 1530 at a second rotatable coupling 1540. The ternary link 1530 is configured so that it is reciprocally movable linearly in a direction that is substantially in the direction of arrow 1570. For exemplary purposes only, the first end and a second end of the ternary link 1530 is movably mounted to respective linear slides 1550A, 1550B which are mounted to the frame 140 in any suitable manner so that the ternary link 1530 (and rotatable couplings 1540, 1541) is capable of moving towards and away from the opening 105 or a front face of the frame 140 (e.g. the portion of the frame through which the opening passes). In alternate embodiments one or more linear slides or other guiding device(s) may be located between the first and second ends of the ternary link 1530 for guiding the substantially linear movement of the ternary link 1530. In still other alternate embodiments the movement of the ternary link 1530 may be guided in any suitable manner. In the exemplary embodiment of FIGS. 10A and 10B, the second end of the ternary link 1530 is rotatably coupled to a first end of the second door link 1520 at a third rotatable coupling 1541. A second end of the second door link is rotatably coupled to the second door at a fourth rotatable coupling 1542 (see FIG. 10B).

In accordance with an exemplary embodiment, the door coupling mechanism 1500 may include one or more toggle devices and/or door latching mechanisms substantially similar to those described above for controlling the motion of the doors.

Still referring to FIGS. 10A and 10B, an exemplary operation of the door coupling mechanism 1500 will be described in accordance with an exemplary embodiment. In this example, a door opening force is applied to the second door 110B in the direction of arrow A4 for causing rotation of the second door about door hinge 152 in the direction of the applied force. Rotation of the second door 110B about the door hinge 152 causes the second door link 1520 to move substantially in the direction of arrow 1571 towards, for example, the front face of the frame 140 The second door link 1520 pivots about the fourth rotatable coupling 1541 during its movement in the direction of arrow 1571 to account for rotation of the second door about door hinge 152. Movement of the second door link 1520 substantially in the direction of arrow 1571 causes the ternary link 1530 to also move in the direction of arrow 1571 along the linear slides 1550A, 1550B. The movement of the ternary link 1530 in the direction of arrow 1571 causes movement of the first door link 1510 substantially in the direction of arrow 1571 for creating a moment C6 between the first rotatable coupling 1539 and the door hinge 151 for causing the simultaneous opening of the first door 110A. First door link 1510 pivots about the first rotatable coupling 1539 during its movement in the direction of arrow 1571 to account for rotation of the first door about door hinge 151. It should also be understood that the door opening force could alternatively be applied to the first door 110A for causing the simultaneous opening of the second door in a manner substantially similar to that described above. Closing of the first and second doors 110A, 110B occurs in a manner substantially opposite to that described above.

It is noted that the configuration of the first and second door links 1510, 1520, the ternary link 1530, the rotatable couplings and/or the linear slides may be such that one of the first and second doors 110A, 110B lags behind the other one of the first and second doors 110A, 110B as the doors are opened or closed in a manner substantially similar to that described above. In alternate embodiments the doors may open and close without any substantial lag relative to each other.

The exemplary door coupling mechanisms described herein may also include one or more stopping members 198 (FIG. 1A) to, for example, limit a maximum opening and/or closing angle of the doors 110A, 110B in accordance with an exemplary embodiment. The stopper member may engage any suitable links of the disclosed door coupling mechanisms. For example, referring to the rotatable ternary link(s) of FIGS. 2, 5, 6, 9A-10B the stopper member may be configured to engage one or more of the ternary links to limit the rotation of a respective ternary link. In another example, referring to the reciprocating ternary links of FIGS. 9A-10B, the stopper member may be configured to engage one or more of the linear slides for limiting the reciprocating motion of a respective link. In alternate embodiments the stopper member may be configured to limit the movement of the doors 110A, 110B in any suitable manner.

In accordance with another exemplary embodiment, one or more of the links of the exemplary door coupling mechanisms described herein may be connected to a motor 197 (see FIG. 1A), such as an electric motor, for driving the one or more links so that the doors 110A, 110B are opened substantially hands free. For example, referring to the rotatable ternary link(s) of FIGS. 2, 5, 6, 9A-10B, the motor may be configured to drive one or more of the ternary links for causing operation of the door coupling mechanism to open or close the doors 110A, 110B. In another example, referring to the reciprocating ternary links of FIGS. 9A-10B the motor may be configured to drive one or more of the linear slides for causing operation of the door coupling mechanism to open or close the doors 110A, 110B. In alternate embodiments the motor may engage the door coupling mechanisms in any suitable manner for opening and closing the doors. It is noted that the rotation of the motor may be controlled in any suitable manner to, for example, substantially fix the open and/or closed positions of the doors 110A, 110B (e.g. limit the movement of the doors in a manner substantially similar to that described above with respect to the stopper member).

In accordance with still another exemplary embodiment, the exemplary door coupling mechanisms described herein may include a damping system 199 (FIG. 1A) configured to resist a rapid acceleration of one or more of the doors 110A, 110B in the event of, for example, a sudden application of excessive door operating force (e.g. an impact force or an otherwise unwanted or unexpected movement of the doors). The damping system 199 may be configured to engage any suitable links, couplings or linear slides of the exemplary embodiments in any suitable manner. The damping system may include, for exemplary purposes only, one or more of hydraulic dampers, mechanical dampers, magnetic dampers or any other suitable force-damping device.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An apparatus comprising:

a frame defining an internal cavity, the frame comprising an opening for accessing the internal cavity;

a first door and a second door hingably mounted to the frame on opposite sides of the opening for selectively closing the opening; and a door coupling mechanism for effecting a substantially simultaneous movement of the first door and the second door relative to the frame, the door coupling mechanism comprising:

a first door link comprising a first end and a second end, the first end of the first door link being rotatably coupled to the first door, a second door link comprising a first end and a second end, the first end of the second door link being rotatably coupled to the second door, a first rotatable ternary link, a second rotatable ternary link, the first and second rotatable ternary links each comprising a lobed portion and a first arm extending outward from the lobed portion and a single piece substantially rigid connecting link comprising a first end and a second end, the first end of the connecting link being rotatably coupled to the first arm of the first ternary link and the second end of the connecting link being rotatably coupled to the lobed portion of the second ternary link, wherein the second end of the first door link is rotatably coupled to the first ternary link and the second end of the second door link is rotatably coupled to the second ternary link.

2. The apparatus of claim 1, where the first and second ternary links each comprise a second arm, the second arm extending outward from the lobed portion, the second end of the first door link being rotatably coupled to the second arm of the first ternary link and the second end of the second door link being rotatably coupled to the second arm of the second ternary link.

3. The apparatus of claim 1, wherein the second end of the first door link is rotatably coupled to a second arm of the first rotatable ternary link and the second end of the second door link is rotatably coupled to the first arm of the second rotatable ternary link.

4. The apparatus of claim 1, further comprising a cooking appliance, a refrigerator, a dishwasher, a clothes washer, or a clothes dryer.

5. The apparatus of claim 1, wherein the door coupling mechanism further comprises a damping system configured to substantially resist an unwanted or unexpected movement of the first and second doors.

6. The apparatus of claim 1, wherein the door coupling mechanism is configured so that one of the first and second doors lags behind the other one of the first and second doors during an opening or closing of the first and second doors.

7. The apparatus of claim 1, wherein the first ternary link or the second ternary link includes a cam surface, the door coupling mechanism further comprising a cam follower mounted to the frame and configured to engage the cam surface for holding the first and second doors in a predetermined position along their path of travel.

8. A door coupling mechanism for effecting simultaneous operation of a first door and a second door mounted to an appliance, the door coupling mechanism comprising:

a first ternary link rotatably mountable relative to a frame of an appliance;

a second ternary link rotatably mountable relative to the frame of the appliance, the first and second ternary links each comprising a lobed portion and a first arm extending outward from the lobed portion;

a first door link able to be rotatably coupled at one end to a first door and rotatably coupled at a second opposite end to the first ternary link;

a second door link able to be rotatably coupled at one end to a second door and rotatably coupled at a second opposite end to the second ternary link; and a single piece substantially rigid connecting link comprising a first end and a second end, the first end of the connecting link being rotatably coupled to the first arm of the first ternary link and the second end of the connecting link being rotatably coupled to the lobed portion of the second ternary link.

9. The door coupling mechanism of claim 8, where the first and second ternary links comprise a second arm, the second arm extending outward from the lobed portion, a first rotatable coupling being on the second arm of the first ternary link, a second rotatable coupling being on the second arm of the second ternary link.

10. The door coupling mechanism of claim 8, wherein the second end of the first door link is rotatably coupled to a second arm of the first ternary link and the second end of the second door link is rotatably coupled to the first arm of the second ternary link.

* * * * *